US007533863B1

(12) United States Patent
Frericks

(10) Patent No.: US 7,533,863 B1
(45) Date of Patent: May 19, 2009

(54) STRAIGHTENING SYSTEM

(76) Inventor: Donald J. Frericks, 17126 Downs Dr., Odessa, FL (US) 33556

( * ) Notice: Subject to any disclaimer, the term of this patent is extended or adjusted under 35 U.S.C. 154(b) by 1388 days.

(21) Appl. No.: 10/117,528

(22) Filed: Apr. 5, 2002

(51) Int. Cl.
*A47G 1/16* (2006.01)

(52) U.S. Cl. ..... 248/494; 248/489

(58) Field of Classification Search ..... 248/489, 248/494, 466, 475.1, 544, 546; 411/460; 40/757, 759, 761; 81/44; 227/147
See application file for complete search history.

(56) References Cited

U.S. PATENT DOCUMENTS

| | | | | | |
|---|---|---|---|---|---|
| 417,805 | A | * | 12/1889 | Beaman | |
| 579,552 | A | * | 3/1897 | Austin | 24/135 R |
| 1,062,464 | A | * | 5/1913 | Haynes | 29/278 |
| 1,177,106 | A | * | 3/1916 | Hickerson | |
| 1,272,696 | A | * | 7/1918 | Mock | |
| 1,413,833 | A | * | 4/1922 | David | |
| 2,643,840 | A | * | 6/1953 | Lanman | |
| 3,300,173 | A | * | 1/1967 | Kennedy, Jr. | 248/467 |
| 3,384,987 | A | * | 5/1968 | Prechtl | |
| 4,390,050 | A | * | 6/1983 | Whitney | 81/44 |
| 5,549,234 | A | * | 8/1996 | Hong | 227/119 |
| 6,070,847 | A | * | 6/2000 | Kirchner | 248/480 |

* cited by examiner

*Primary Examiner*—Gwendolyn Baxter
(74) *Attorney, Agent, or Firm*—Edward P Dutkiewicz

(57) ABSTRACT

A straightening system has a handle formed of a rigid material. The handle has a gripping portion in a generally cylindrical configuration adapted to be held by a hand of a user and a support portion in a generally cylindrical configuration extending at right angles from a central extent of the gripping portion. The support portion terminates in a flat region remote from the gripping portion. A pin assembly couples an object to a wall to insure proper positioning and retention of the proper positioning. The pin assembly has a circular disc-shaped center with an axis parallel with the axis of the support portion. The pin assembly has at least one outwardly extending pin for positioning in the wall adjacent an object and an inwardly directed attachment member for positioning with respect to the object.

1 Claim, 4 Drawing Sheets

FIG 3
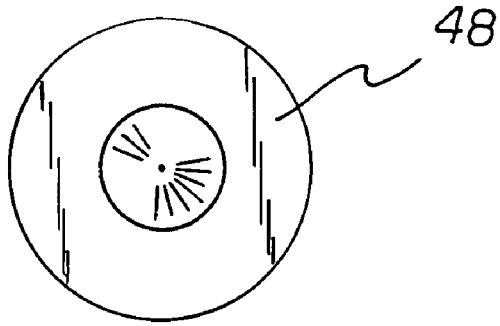
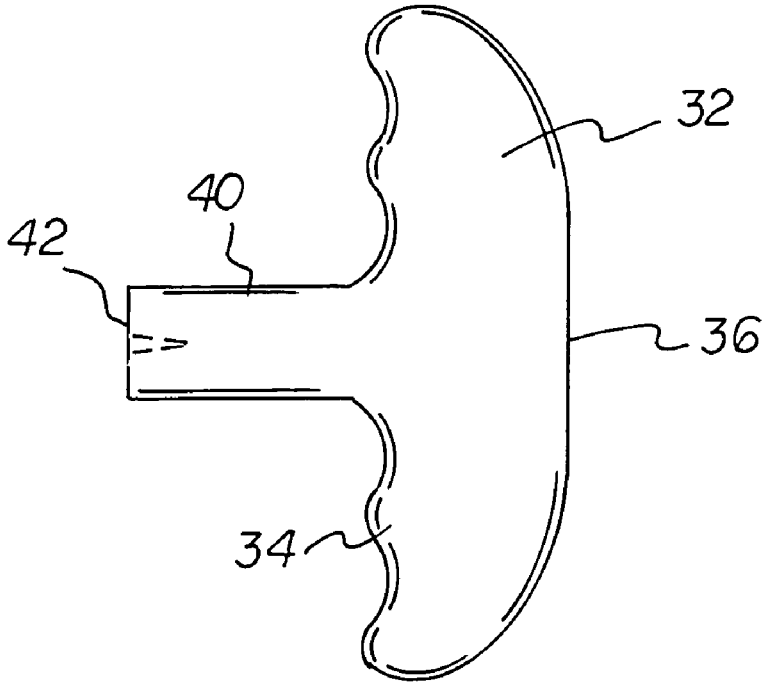
FIG 4

FIG 5
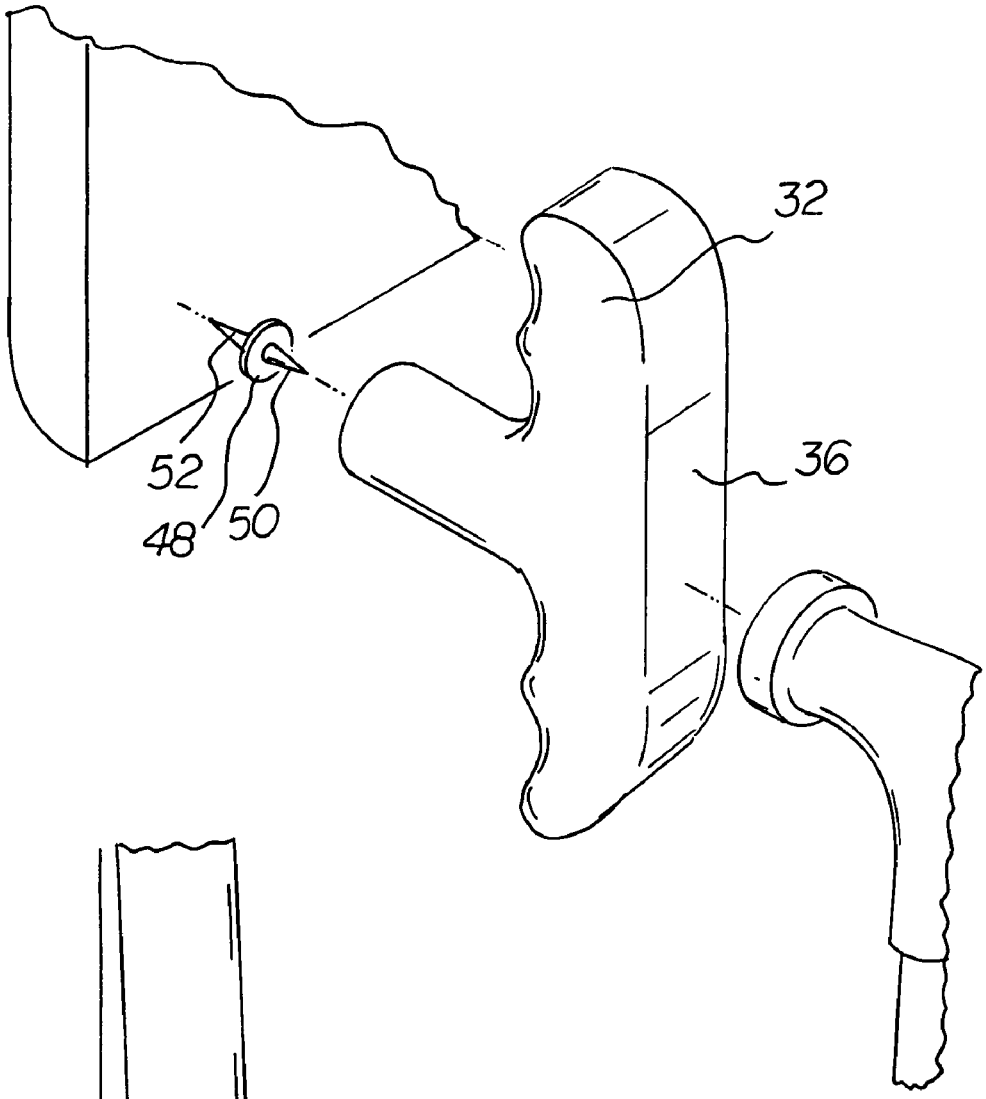
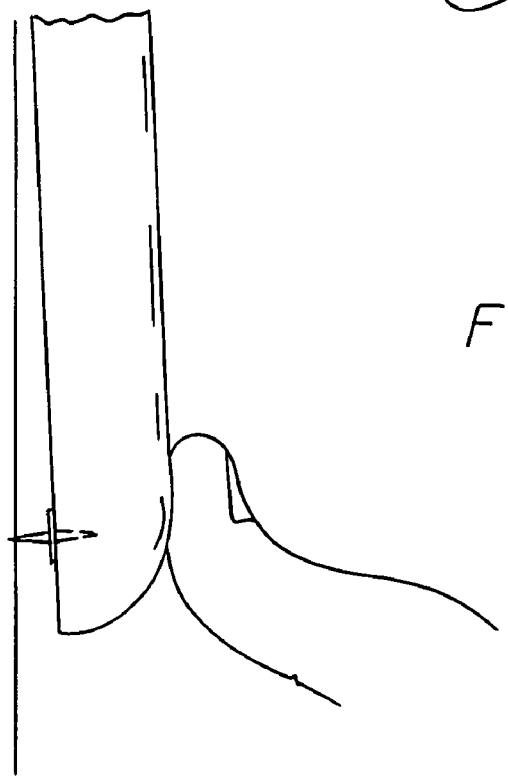
FIG 6

FIG 7
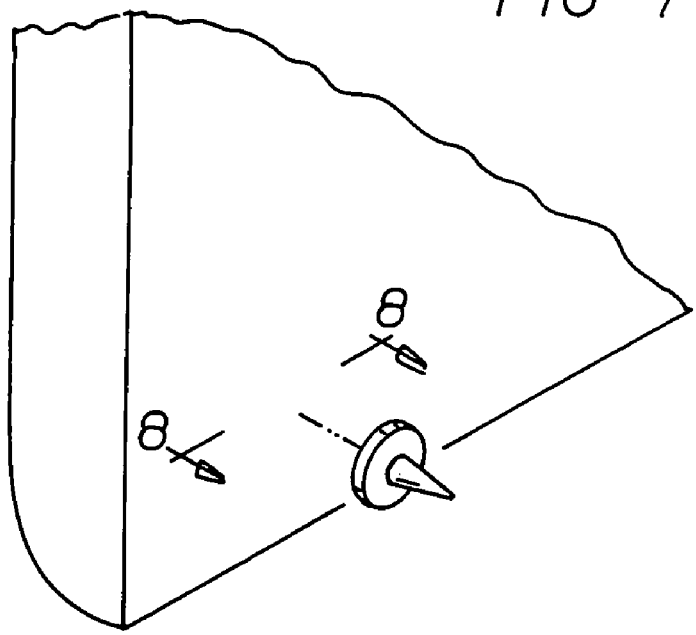
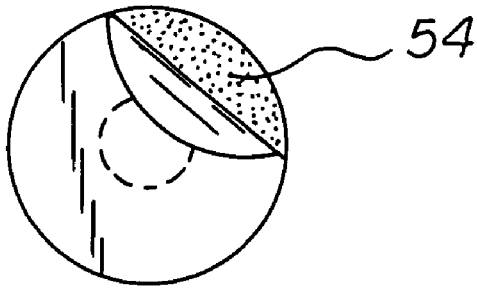
FIG 8

STRAIGHTENING SYSTEM

BACKGROUND OF THE INVENTION

1. Field of the Invention

The present invention relates to a straightening system and more particularly pertains to insuring that objects are hung or retained in a proper orientation.

2. Description of the Prior Art

The use of straightening systems of known designs and configurations is known in the prior art. More specifically, straightening systems of known designs and configurations previously devised and utilized for the purpose of hanging and retaining objects in proper orientation are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,454,542 to Hart discloses Apparatus and Methods for Hanging Frames. U.S. Pat. No. 6,186,466 to Baird et al. discloses a Hanging Frame Stabilizer. U.S. Pat. No. 2,127,078 to Zwicker et al. discloses a Frame for Pictures, Photographs, Placards, or the like. U.S. Pat. No. 4,881,333 to Manrubia discloses a Frame Stabilizing Apparatus. U.S. Pat. No. 920,236 to Walls discloses a Device for Attaching Pictures, etc. to Walls. U.S. Pat. No. 1,499,826 to Kassabaum discloses Improvements in Nails. U.S. Pat. No. 6,095,478 to Barnes discloses a Picture Hanging System and Method. U.S. Pat. No. Des. 235,308 to Clarke discloses a Picture Hanger Stabilizer. Finally, U.S. Pat. No. Des. 402,183 to Bellehumeur discloses a Picture Frame Stabilizer.

While these devices fulfill their respective, particular objectives and requirements, the aforementioned patents do not describe straightening system that allows insuring that objects are hung or retained in a proper orientation.

In this respect, the straightening system according to the present invention substantially departs from the conventional concepts and designs of the prior art, and in doing so provides an apparatus primarily developed for the purpose of insuring that objects are hung or retained in a proper orientation.

Therefore, it can be appreciated that there exists a continuing need for a new and improved straightening system which can be used for insuring that objects are hung or retained in a proper orientation. In this regard, the present invention substantially fulfills this need.

SUMMARY OF THE INVENTION

In view of the foregoing disadvantages inherent in the known types of straightening systems of known designs and configurations now present in the prior art, the present invention provides an improved straightening system. As such, the general purpose of the present invention, which will be described subsequently in greater detail, is to provide a new and improved straightening system and method which has all the advantages of the prior art and none of the disadvantages.

To attain this, the present invention essentially comprises a straightening system. First provided is an object having a back panel adapted to face a wall. Next, a hanging assembly is provided. The hanging assembly has a first screw adapted to be attached to a left half of the back panel and a second screw adapted to be attached to the right half of the back. The hanging assembly also has a wire with two ends each adapted to be attached to one of the screws. A hanger is next provided. The hanger is adapted to be attached to a wall and to receive the wire. The hanger may simply be a nail or a more elaborate hanger of known designs. Next provided is a handle. The handle has a gripping portion formed of a rigid material in a generally cylindrical configuration adapted to be held by a hand of a user. A flat portion of the handle is provided. The flat portion allows the handle to be struck with a hammer for uses when more force is required. The handle also has a support portion. The support portion is formed of a rigid material in a generally cylindrical configuration extending at right angles from a central extent of the gripping portion. The support portion terminates in a flat circular region remote from the gripping portion. A cone-shaped recess is provided in the in the center of the support portion. Finally, a pin assembly is provided. The pin assembly is for coupling an object to a wall to insure proper positioning and retention of the proper positioning. The pin assembly has a circular disc-shaped center with an axis parallel with the axis of the support portion. The pin assembly has two pins. One of the two pins is an outwardly extending pin for positioning in the wall adjacent an object. The second pin is an inwardly directed pin for positioning into the object.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved straightening system which has all of the advantages of the prior art straightening systems of known designs and configurations and none of the disadvantages.

It is another object of the present invention to provide a new and improved straightening system which may be easily and efficiently manufactured and marketed.

It is further object of the present invention to provide a new and improved straightening system which is of durable and reliable constructions.

An even further object of the present invention is to provide a new and improved straightening system which is susceptible of a low cost of manufacture with regard to both materials and labor, and which accordingly is then susceptible of low prices of sale to the consuming public, thereby making such straightening system economically available to the buying public.

Even still another object of the present invention is to provide a straightening system for insuring that objects are hung or retained in a proper orientation.

Lastly, it is an object of the present invention to provide a new and improved straightening system having a handle formed of a rigid material with a gripping portion adapted to be held by a hand of a user and a support portion terminating in a flat region remote from the gripping portion, a pin assembly coupling an object to a wall to insure proper positioning and retention of the proper positioning, the pin assembly having a circular disc-shaped center with an axis parallel with the axis of the support portion, the pin assembly having at least one outwardly extending pin for positioning in the wall adjacent an object and an inwardly directed attachment member for positioning with respect to the object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cut-away view of the pin assembly taken along line 3-3 of FIG. 2.

FIG. 4 is a side elevational view of the handle of the present invention.

FIG. 5 is a perspective view showing the handle and pin assembly in use with a hammer for striking.

FIG. 6 is a perspective view showing the final positioning of the object to the wall.

FIG. 7 is a perspective illustration of an alternate embodiment of the invention in which the pin assembly is attached to the object with adhesive.

FIG. 8 is a rear elevational view of the pin assembly of the alternate embodiment of the invention taken along line 80-8 of FIG. 7.

The same reference numerals refer to the same parts throughout the various Figures.

DESCRIPTION OF THE PREFERRED EMBODIMENT

Figure 1:
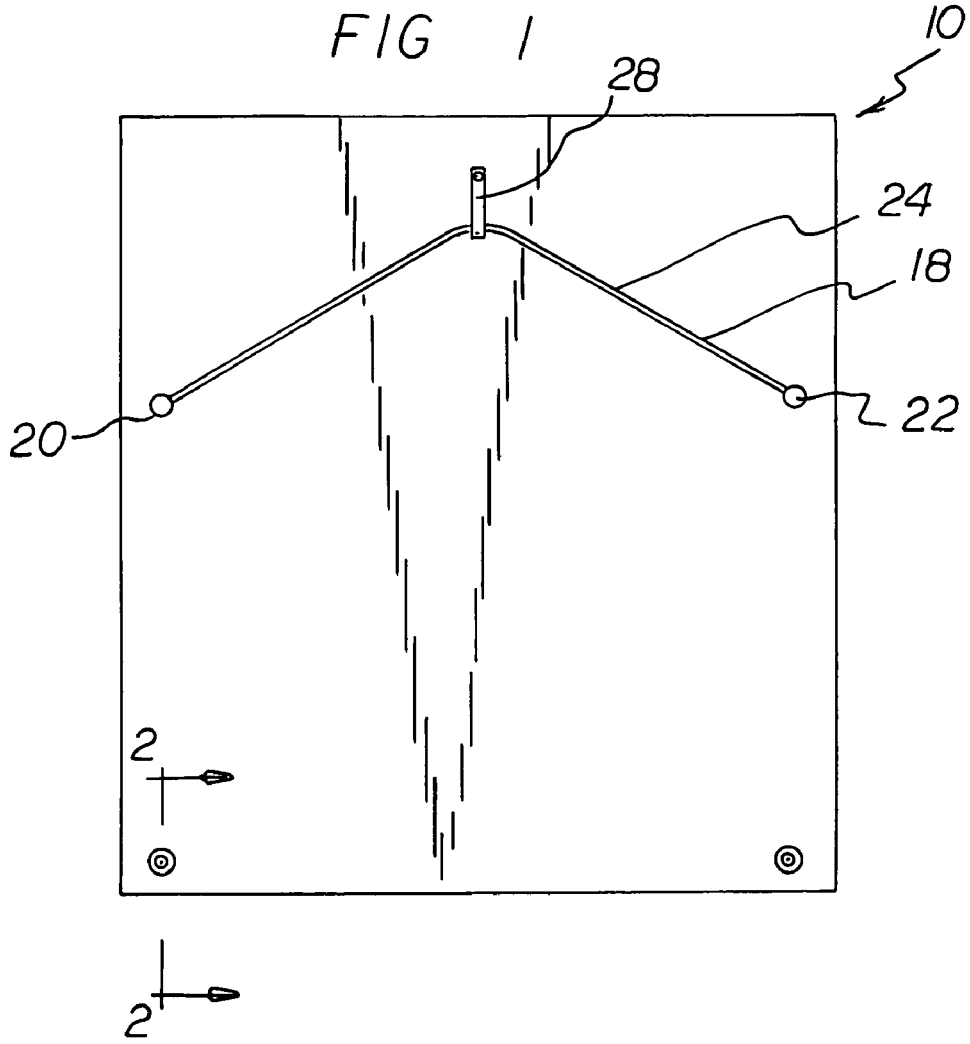
FIG. 1 is a rear elevational view of the object, hanging assembly, and pin assembly of the present invention constructed in accordance with the principles of the present invention.
Figure 2:
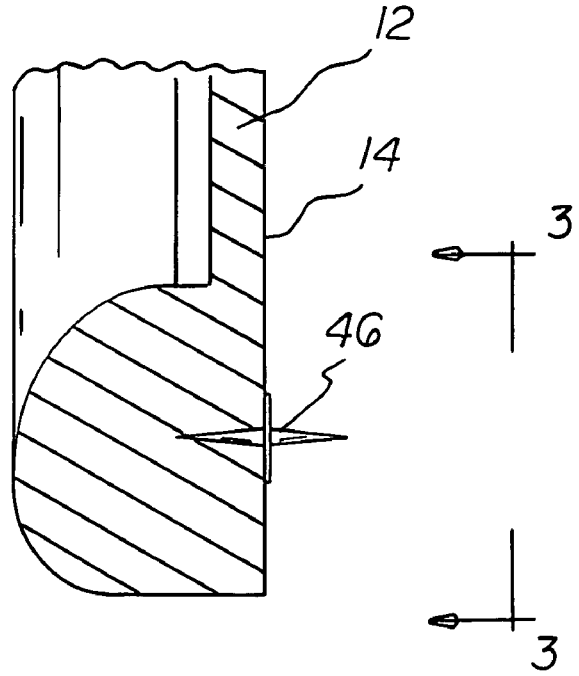
FIG. 2 is a cross-sectional view taken along line 2-2 of FIG. 1 showing the pin assembly in operation and use.

With reference now to the drawings, and in particular to FIG. 1 thereof, the preferred embodiment of the new and improved straightening system embodying the principles and concepts of the present invention and generally designated by the reference numeral 10 will be described.

The present invention, the straightening system 10 is comprised of a plurality of components. Such components in their broadest context include a handle and a pin assembly. Such components are individually configured and correlated with respect to each other so as to attain the desired objective.

First provided is an object 12 having a back panel 14 adapted to face a wall.

Next, a hanging assembly 18 is provided. The hanging assembly has a first screw 20 adapted to be attached to a left half of the back panel and a second screw 22 adapted to be attached to the right half of the back. The hanging assembly also has a wire 24 with two ends each adapted to be attached to one of the screws.

A hanger 28 is next provided. The hanger is adapted to be attached to a wall and to receive the wire. The hanger may simply be a nail or a more elaborate hanger of known designs.

Next provided is a handle 32. The handle has a gripping portion 34 formed of a rigid material in a generally cylindrical configuration adapted to be held by a hand of a user. A flat portion of the handle 36 is provided. The flat portion allows the handle to be struck with a hammer for uses when more force is required.

The handle also has a support portion 40. The support portion is formed of a rigid material in a generally cylindrical configuration extending at right angles from a central extent of the gripping portion. The support portion terminates in a flat circular region 42 remote from the gripping portion. A cone-shaped recess is provided in the in the center of the support portion.

Finally, a pin assembly 46 is provided. The pin assembly is for coupling an object to a wall to insure proper positioning and retention of the proper positioning. The pin assembly has a circular disc-shaped center 48 with an axis parallel with the axis of the support portion. The pin assembly has two pins 50, 52. One of the two pins is an outwardly extending pin 50 for positioning in the wall adjacent an object. The second pin is an inwardly directed pin 52 for positioning into the object.

An alternate embodiment of the invention is shown in FIGS. 7 and 8. In this embodiment, the pin assembly has at least one outwardly extending pin for positioning in the wall adjacent an object and an inwardly directed attachment member in the form of an adhesive layer 54 positioned to couple the pin assembly to a portion of the object. The adhesive layer is preferably covered with a protective sheet which is peeled off to then attach the pin assembly to the object. This embodiment is for use with objects fabricated of metal, plastic and like material which are difficult to penetrate with a pin.

Using the handle, a pin assembly is inserted in the bottom side of the object that will face the wall. Preferably, two pin assembly area used. The flat area of the handle allows for striking with a hammer if necessary to secure the pin assembly to the object. Alternatively, the pin assembly having an adhesive is adhered to the side of the object that will face the wall. The object is then hung on the wall in the normal fashion insuring that it is in the desired orientation. Once it has been positioned on the wall and the orientation, straight and level if that is the desired orientation, is checked, the bottom of the picture, or object, is gently pushed toward the wall. The pin assembly will stick into the wall, insuring the picture will not shift. The object will remain in this orientation through dusting, shaking, bumping, or other disturbances.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A straightening system for insuring that an object is hung and retained in a proper horizontal and vertical orientation with respect to a wall comprising, in combination:

an object having a back panel adapted to face the wall;

a hanging assembly having a first screw adapted to be attached to a left half of the back panel and a second screw adapted to be attached to the right half of the back panel, the hanging assembly also have a wire with two ends each adapted to be attached to one of the screws;

a hanger adapted to be attached to the wall and to receive the wire;

a handle having a gripping portion formed of a rigid material in a generally cylindrical configuration adapted to be held by a hand of a user and having a flat portion adapted to be struck with a hammer;

the handle also having a support portion formed of a rigid material in a generally cylindrical configuration extending at right angles from a central extent of the gripping portion, the support portion terminating in a flat circular region remote from the gripping portion, the support portion having a cone-shaped recess in the center thereof; and a pin assembly for coupling the object to the wall to insure proper positioning and retention of the proper positioning, the pin assembly having a circular disc-shaped center with a first planar surface and an opposed second planar surface and with an axis parallel with the axis of the support portion, the pin assembly having two pins, an outwardly extending pin for positioning in the object adjacent the wall with the first planar surface in facing contact with the object during use and an inwardly directed pin for positioning into the cone-shaped recess with the second planar surface in facing contact with the flat circular region during insertion into the object whereby pressure on the flat portion of the handle will transfer forces from the flat circular region of the handle to the second planar surface of the pin assembly for driving the outwardly extending pin into the object.

* * * * *